US010201258B1

(12) United States Patent
Murphy

(10) Patent No.: US 10,201,258 B1
(45) Date of Patent: Feb. 12, 2019

(54) LAYERED TOILET SEAT

(71) Applicant: Kohler Co., Kohler, WI (US)

(72) Inventor: Roger W. Murphy, Kohler, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/674,044

(22) Filed: Aug. 10, 2017

(51) Int. Cl.
*A47K 13/00* (2006.01)
*A47K 13/24* (2006.01)
*A47K 13/12* (2006.01)

(52) U.S. Cl.
CPC ..... *A47K 13/24* (2013.01); *A47K 13/12* (2013.01)

(58) Field of Classification Search
CPC ..... A47K 13/24; A47K 13/12
USPC ..... 4/234
See application file for complete search history.

(56) References Cited

U.S. PATENT DOCUMENTS 1,315,488 A 9/1919 Franklin
1,679,202 A 7/1928 Bishop
2,069,301 A 2/1937 Carlson
3,484,876 A * 12/1969 Thomas ..... A47K 13/02 4/234
6,543,065 B2 4/2003 Hsieh
6,640,349 B2 11/2003 Toldo et al.
6,959,458 B1 * 11/2005 Tsai ..... A47K 13/00 4/234
8,296,870 B2 10/2012 Kannengiesser
9,131,813 B2 9/2015 Zhang
9,346,245 B2 5/2016 Wu et al.
9,636,896 B2 * 5/2017 Wu ..... A47K 13/02
2005/0071917 A1 * 4/2005 Landon ..... A47K 13/24 4/661
2011/0146792 A1 * 6/2011 Wu ..... B32B 17/10 136/259
2012/0266371 A1 * 10/2012 Zhang ..... A47K 13/24 4/242.1
2014/0047627 A1 * 2/2014 Wu ..... A47K 13/24 4/242.1

* cited by examiner

*Primary Examiner* — Huyen Le
(74) *Attorney, Agent, or Firm* — Foley & Lardner LLP

(57) ABSTRACT

A toilet seat includes a first layer, a second layer, and a third layer. The first layer includes a first wood board. The first layer has a first surface and a second surface. The second layer includes a flexible material. The second layer is coupled to the second surface of the first layer. The third layer includes a second wood board. The third layer is coupled to the second layer opposite the first layer.

20 Claims, 8 Drawing Sheets

LAYERED TOILET SEAT

BACKGROUND

The Present Application Relates Generally to the Field of Toilet Seats.

Generally speaking, a toilet seat assembly is a hinged structure attached to a toilet that functions to allow a user to sit on the toilet without sitting directly on a bowl of the toilet. A toilet seat assembly may include a seat and a cover. The seat and the cover may be rotatable with respect to the toilet bowl.

SUMMARY

One embodiment of the present disclosure is related to a toilet seat. The toilet seat includes a first layer, a second layer, and a third layer. The first layer includes a first wood board. The first layer has a first surface and a second surface. The second layer includes a flexible material. The second layer is coupled to the second surface of the first layer. The third layer includes a second wood board. The third layer is coupled to the second layer opposite the first layer.

Another embodiment of the present disclosure is related to a toilet seat assembly. The toilet seat assembly includes a seat and a cover. The cover is coupled to the seat. The cover is rotatable with respect to the seat. One of the seat and the cover includes a first layer, a second layer, and a third layer. The first layer includes a first board and a second board. The second layer includes a first flexible material. The first flexible material has a first side and a second side opposite the first side. The first side is coupled to the first board and the second board. The third layer includes a third board and a fourth board. The third board and the fourth board are coupled to the second side.

Still another embodiment of the present disclosure is related to a toilet seat. The toilet seat includes a first layer, a second layer, and a third layer. The first layer includes a first board, a second board, a third board, and a fourth board. The second layer includes a flexible material having a first side and a second side opposite the first side. The first side is coupled to the first board, the second board, the third board, and the fourth board. The third layer includes a fifth board, a sixth board, and a seventh board. The fifth board, the sixth board, and the seventh board are coupled to the second side. The first board, the second board, the third board, and the fourth board are aligned along a first plane. The fifth board, the sixth board, and the seventh board are aligned along a second plane parallel to the first plane.

It is to be understood that both the foregoing general description and the following detailed description are exemplary and explanatory only and are not restrictive of the invention as claimed.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Certain toilet seat assemblies are susceptible to cracking and splitting due to the relatively inflexible nature of the material used to make the seat assemblies. As a result, these toilet seat assemblies must be relatively thick and cannot be easily contoured into a desired shape, such as a rounded or sloped shape. Other toilet seat assemblies are relatively flat in form. Still other toilet seat assemblies do not exhibit natural wood grain and may be aesthetically undesirable. Still other toilet seat assemblies are susceptible to peeling, cracking, and having rough and jagged surfaces and edges.

An opportunity exists for providing a toilet seat assembly with a wooden aesthetic appearance that is resistant to cracking and splitting, that can be relatively easily contoured into a target shape, that exhibits natural wood grain, and that is resistant to peeling, cracking, and other degradation. Such a toilet seat assembly would provide a user with the aesthetic benefits of wood along with the structural benefits of plastic or polymeric materials and would therefore be more desirable than conventional toilet seat assemblies.

Figure 1:
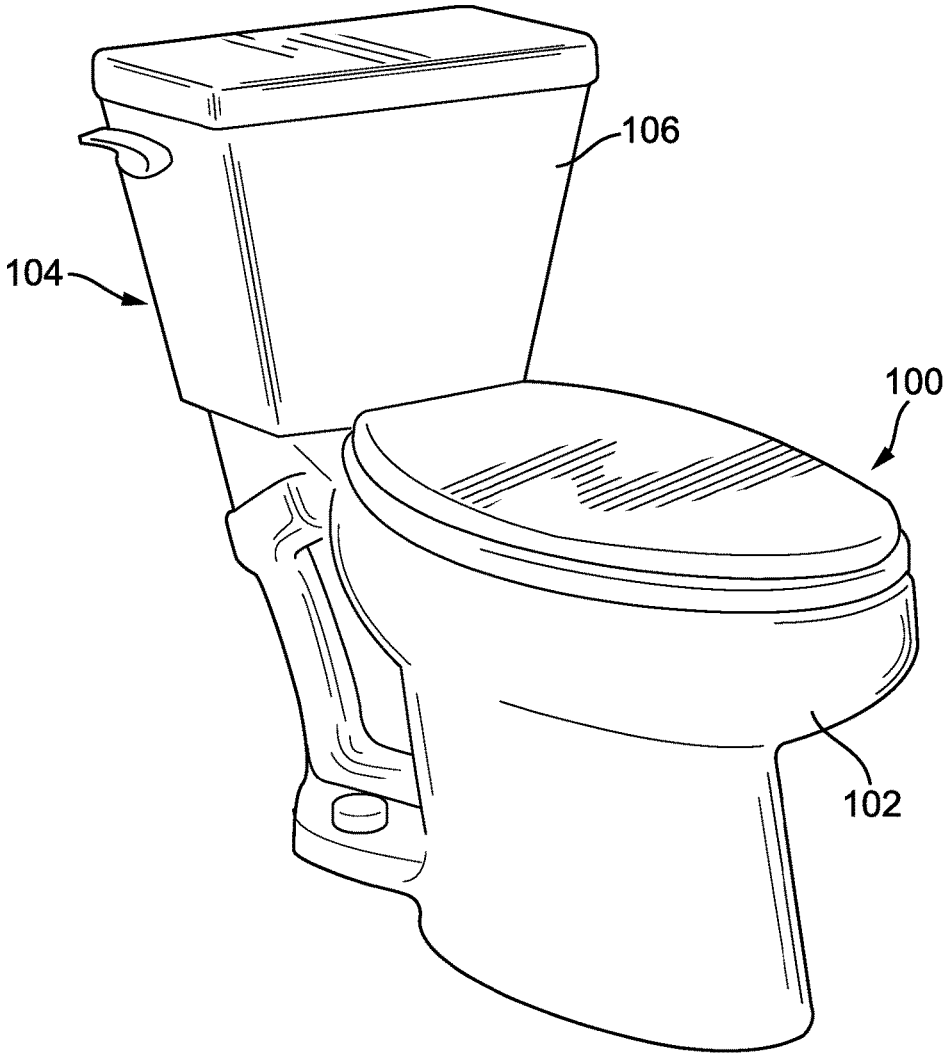
FIG. 1 is a top perspective view of a toilet including a toilet seat assembly, according to an exemplary embodiment of the present disclosure.

Referring to FIG. 1, an assembly (e.g., mechanism, system, covering system, etc.), shown as a toilet seat assembly 100, is shown coupled (e.g., attached, adhered, affixed, bonded, glued, joined, etc.) to a bowl (e.g., base, basin, etc.), shown as a bowl 102, of a toilet, shown as a toilet 104. The toilet seat assembly 100 is utilized by a user to interface with the toilet 104 without interfacing with the bowl 102. The toilet 104 includes a structure (e.g., component, etc.), shown as a tank 106. The toilet seat assembly 100 may selectively interface with the bowl 102 and the tank 106. While the toilet 104 is shown as a residential toilet, the toilet 104 may also be a tank-less toilet, a Flushometer toilet, a portable toilet, a commercial toilet, an industrial toilet, or any other similar toilet.

Figure 2:
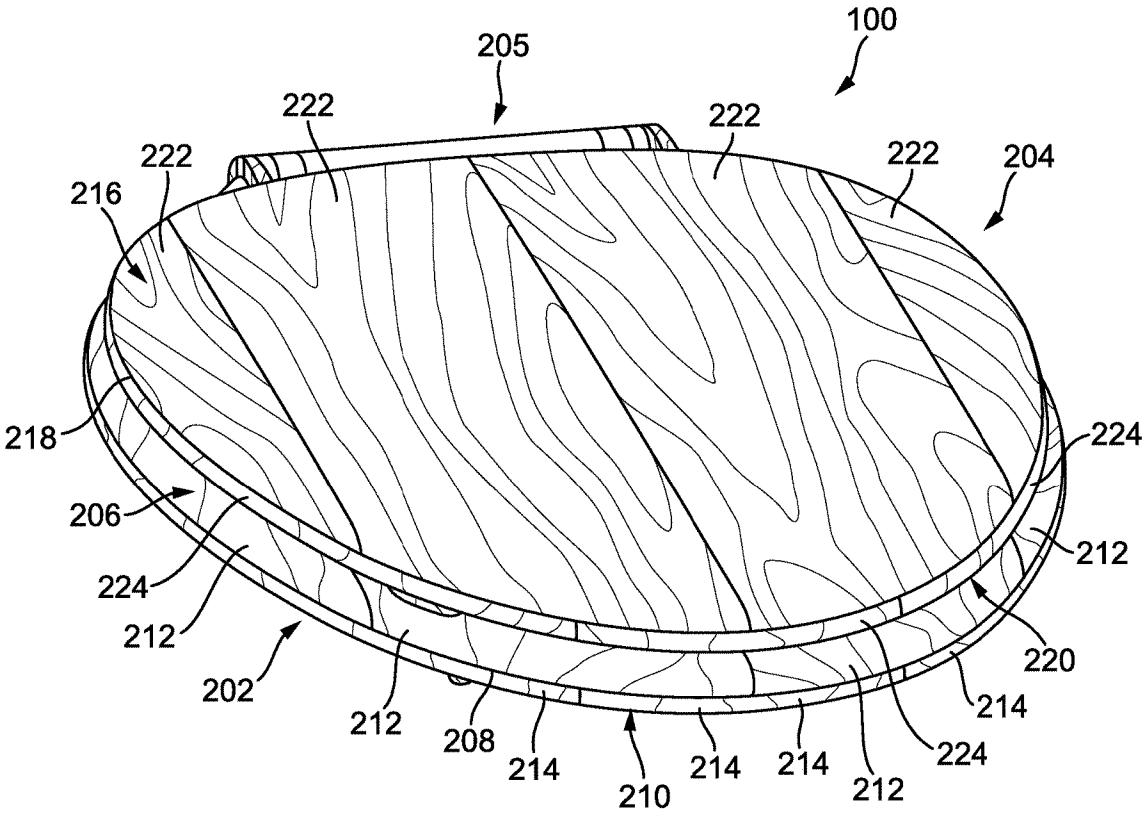
FIG. 2 is a top perspective view of a toilet seat assembly, according to an exemplary embodiment of the present disclosure.

As shown in FIG. 2, the toilet seat assembly 100 includes a first member (e.g., base, bottom, etc.), shown as a seat 202, a second member (e.g., lid, top, etc.), shown as a cover 204, and a hinge, shown as a hinge 205. The seat 202 and the cover 204 each facilitate different interactions by the user with the toilet 104. As will be explained in more detail herein, the seat 202 and the cover 204 are capable of (e.g., configured to, structured to, etc.) rotating with respect to the bowl 102 of the toilet 104. Depending on the relative position of the seat 202 and the cover 204, each of the seat 202 and the cover 204 may be independently rotatable. The hinge 205 is coupled to the bowl 102 and to each of the seat 202 and the cover 204. The rotation of the seat 202 and the cover 204 is facilitated by the hinge 205. Through the hinge 205, or another similar structure, the cover 204 is coupled (e.g., rotatably coupled, etc.) to the seat 202.

The seat 202 is selectively rotatable between a first position—where the seat 202 contacts the bowl 102 and is thereby supported—and a second position—where the cover 204 contacts a vertical structure (e.g., the tank 106, a wall, a stop on a hinge, etc.) and is thereby supported and where the seat 202 contacts the cover 204 and is supported thereby. The cover 204 is selectively rotatable between a first position—where the seat 202 contacts the bowl 102 and is supported thereby and where the cover 204 contacts the seat 202 and is supported thereby—and a second position—where the cover 204 contacts a vertical structure and is supported thereby.

When the seat 202 is in the first position, the cover 204 may be independently rotated between the first position and the second position. For example, the cover 204 may be in the first position when the toilet 104 is not in use and in the second position when toilet 104 is in use. When the cover 204 is in the second position, the seat 202 may be independently rotated between the first position and the second position. For example, the seat 202 may be in the first position when a user interacts with the bowl 102 in a first way and in the second position when a user interacts with the bowl 102 in a second way.

In an exemplary embodiment, each of the seat 202 and the cover 204 is constructed from a multi-layer (e.g., a three-layer, etc.) construction that combines the aesthetic benefits of natural wood and the structural benefits of a flexible core. As shown in FIG. 2, in one embodiment, the seat 202 is constructed from a first layer (e.g., sheet, etc.), shown as a top layer 206, a second layer, shown as a middle layer 208, and a third layer, shown as a bottom layer 210. The top layer 206 is coupled to the middle layer 208, which is also coupled to the bottom layer 210. The top layer 206 includes a plurality of individual boards (e.g., slats, pieces, components, etc.), shown as top boards 212, and the bottom layer 210 includes a plurality of individual boards, shown as bottom boards 214.

As also shown in FIG. 2, the cover 204 is constructed from a first layer (e.g., sheet, etc.), shown as a top layer 216, a second layer, shown as a middle layer 218, and a third layer, shown as a bottom layer 220. The top layer 216 is coupled to the middle layer 218, which is also coupled to the bottom layer 220. The top layer 216 includes a plurality of individual boards (e.g., slats, pieces, components, etc.), shown as top boards 222, and the bottom layer 210 includes a plurality of individual boards, shown as bottom boards 224.

In some embodiments, the top layer 206, the bottom layer 210, the top layer 216, and the bottom layer 220 are each constructed from solid wood (e.g., sapele wood, oak wood, bamboo wood, pine wood, maple wood, walnut wood, cherry wood, etc.) pieces. For example, the top layer 206, the bottom layer 210, the top layer 216, and the bottom layer 220 may be constructed from pieces of oak wood. Because of this solid wood construction, each of the top layer 206, the bottom layer 210, the top layer 216, and the bottom layer 220 displays (e.g., exhibits, provides, etc.) the natural grain of the wood. In this way, the seat 202 and the cover 204 provide a significant aesthetic enhancement over conventional wood flour toilet seat assemblies which do not display any sort of natural grain. The aesthetic appearance of the natural grain of wood may be valued because of its aesthetic value (e.g., natural beauty, etc.) or because such an appearance may convey a sense of high quality. The top layer 206, the bottom layer 210, the top layer 216, and the bottom layer 220 may be stained, painted, or otherwise treated (e.g., coated, clear coated, water treated, etc.).

In one embodiment, the middle layer 208 and the middle layer 218 are constructed from a flexible material (e.g., instead of a wood or wood flour material, etc.). The middle layer 208 and the middle layer 218 may be constructed from the same flexible material or different flexible materials. The flexible material of either of the middle layer 208 or the middle layer 218 is different from the wood that the top layer 206, the bottom layer 210, the top layer 216, and the bottom layer 220 are constructed from. The flexible material of either of the middle layer 208 or the middle layer 218 may be a composite material, laminate (e.g., mica laminate, silicon bonded laminate, etc.), polyurethane, phenolic (e.g., paper phenolic, cotton cloth phenolic, glass cloth melamine, etc.), Stonewood (e.g., produced by Fiberesin Industries, etc.), layered mesh sheets, Fiberglas, resin, fiber, melamine, epoxy, and other similar materials. Rather than a single layer of flexible material, the middle layer 208 and/or the middle layer 218 may include a plurality of stacked layers bonded or otherwise adhered to form a single collective layer. Each of the stacked layers may be different from the others of the stacked layers such that a middle layer 208 and/or a middle layer 218 with various characteristics may be formed. For example, the middle layer 208 may be constructed from a first layer of Stonewood adhered to a layer of melamine which is further adhered to a second layer of Stonewood, such that the layer of melamine is sandwiched between layers of Stonewood.

In some embodiments, the middle layer 208 has a modulus of elasticity (e.g., elastic modulus, Young's modulus, tensile modulus, etc.) that is less than a modulus of elasticity of each of the top layer 206 and the bottom layer 210. Similarly, the middle layer 218 has a modulus of elasticity that is less than a modulus of elasticity of each of the top layer 216 and the bottom layer 220. For example, each of the top layer 206, the bottom layer 210, the top layer 216, and the bottom layer 220 may have a modulus of elasticity on the order of 9-12.5 gigapascals (GPa) and each of the middle layer 208 and the middle layer 218 may have a modulus of elasticity on the order of 0.08-0.12 GPa.

Figure 3:
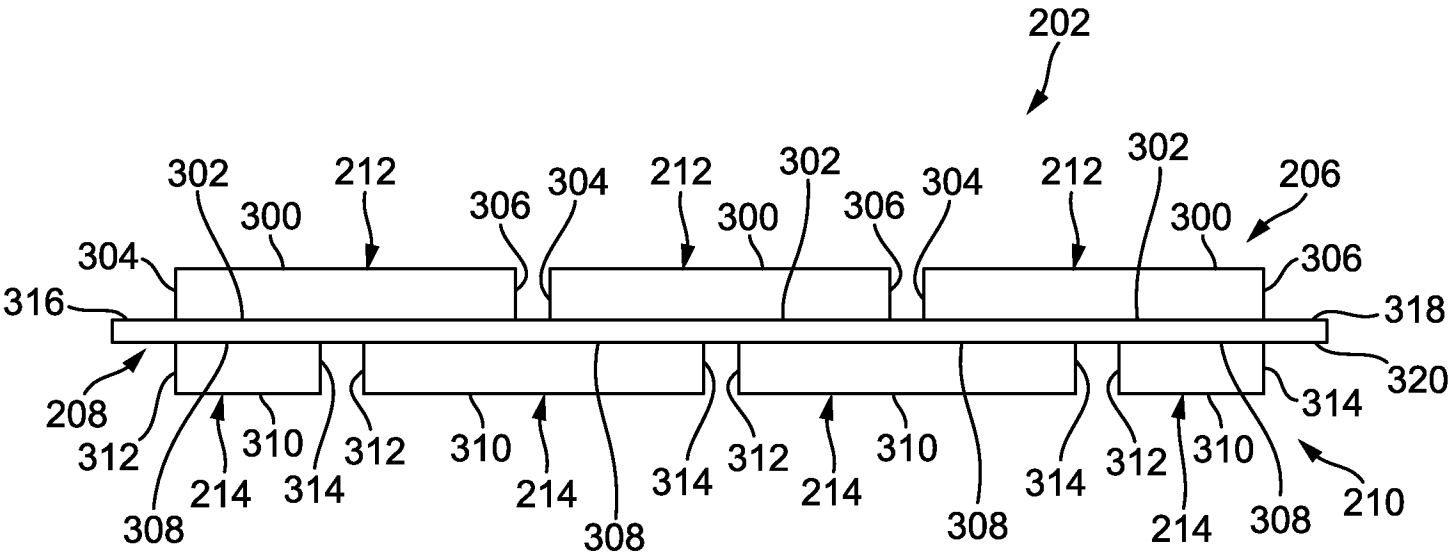
FIG. 3 is a cross-sectional view of a seat for a toilet seat assembly, according to an exemplary embodiment of the present disclosure.

FIG. 3 illustrates the seat 202 in greater detail. As shown in FIG. 3, the top layer 206 is disposed (e.g., aligned, centered, oriented, etc.) along a first plane, the middle layer 208 is disposed along a second plane parallel to the first plane, and the bottom layer 210 is disposed along a third plane parallel to the second plane.

Each of the top boards 212 includes a first face 300, a second face 302 parallel to the first face 300, a first lateral side 304, and a second lateral side 306 parallel to the first lateral side 304. Similarly, each of the bottom boards 214 includes a first face 308, a second face 310 parallel to the first face 308, a first lateral side 312, and a second lateral side 314 parallel to the first lateral side 312. According to an exemplary embodiment, the middle layer 208 includes a single flexible member 316 having a first side 318 and a second side 320 parallel to the first side 318. In other embodiments, the middle layer 208 includes additional members having lateral sides as described with the top boards 212 and the bottom boards 214.

In an exemplary embodiment, the second side 302 of each of the top boards 212 is coupled to the first side 318 of the flexible member 316 and the first side 308 of each of the bottom boards 214 is coupled to the second side 320 of the flexible member 316. The first side 300 of the top boards 212 is contoured (e.g., shaped, etc.) relative to the second face 310 of the bottom boards 214.

In an exemplary embodiment, each of the top boards 212 is individually coupled to at least one adjacent top board 212, and each of the bottom boards 214 is individually coupled to at least one adjacent bottom board 214. In some applications, the first lateral side 304 of one of the top boards 212 and the second lateral side 306 of an adjacent one of the top boards 212 each include a corresponding structural feature (e.g., protrusion, slot, etc.) configured to interact with one another to facilitate coupling of the adjacent top boards 212. For example, the first lateral side 304 may include a tongue, and the second lateral side 306 may include a corresponding groove structured (e.g., configured, etc.) to receive the tongue. Similarly, the bottom layer 210 is constructed (e.g., configured, structured, etc.) such that the first lateral side 312 of one of the bottom boards 214 interfaces with the second lateral side 314 of an adjacent one of the bottom boards 214. In some applications, the first lateral side 312 of one of the bottom boards 214 and the second lateral side 314 of an adjacent one of the bottom boards 214 each include a corresponding structural feature (e.g., protrusion, slot, etc.) configured to interact with one another to facilitate coupling of the adjacent bottom boards 214. For example, the first lateral side 312 may include a tongue and the second lateral side 314 may include a corresponding groove structured (e.g., configured, etc.) to receive the tongue.

As shown in FIG. 3, the top layer 206 and the bottom layer 210 are configured (e.g., structured, etc.) such that interfaces between adjacent top boards 212 are offset (e.g., staggered, etc.) from interfaces between adjacent bottom boards 214 by a target distance. For example, interfaces between adjacent top boards 212 may be individually offset from an adjacent interface between adjacent bottom boards 214 by a target distance equal to half the length of one of an adjacent bottom board 214. By offsetting these interfaces, the structural integrity of the seat 202 is increased. In order to facilitate the offsetting of these interfaces, the seat 202 may include different numbers and/or different sizes of the top boards 212 and the bottom boards 214.

The top layer 206 and the bottom layer 210 are configured such that a minimal number of the top boards 212 and a minimal number of the bottom boards 214 are utilized in the construction of the seat 202. The number of the top boards 212 and the number of the bottom boards 214 that are utilized in the construction of the seat 202 are based on the properties (e.g., modulus of elasticity, thickness, etc.) of the top boards 212 and the bottom boards 214, as well as the properties of the middle layer 208. For example, assuming that the top boards 212 and the bottom boards 214 are constructed from the same material, the seat 202 may be constructed from relatively fewer of the top boards 212 and the bottom boards 214 when the material has a lower modulus of elasticity, and relatively more of the top boards 212 and the bottom boards 214 when the material has a greater modulus of elasticity, assuming that the properties of the middle layer 208 are not varied. In this way, the material that the top boards 212 are constructed from is directly related to the number of the top boards 212 that are included in the top layer 206, and the material that the bottom boards 214 are constructed from is directly related to the number of the bottom boards 214 that are included in the bottom layer 210.

Figure 4:
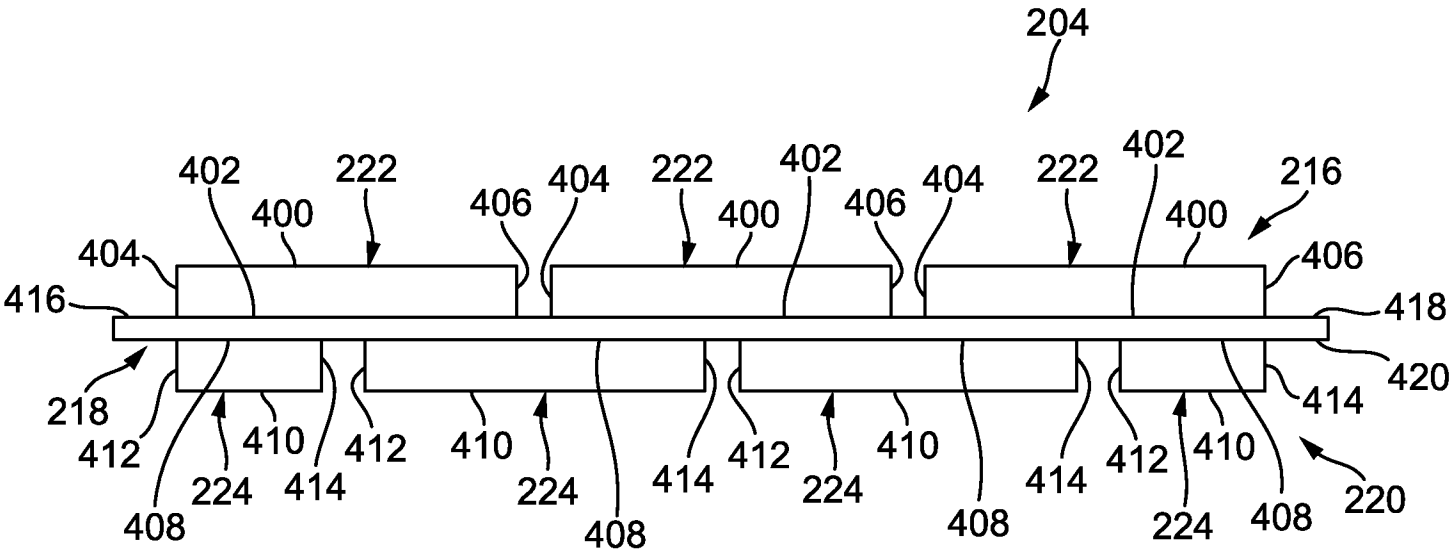
FIG. 4 is a cross-sectional view of a cover for a toilet seat assembly, according to an exemplary embodiment of the present disclosure.

FIG. 4 illustrates the cover 204 in greater detail. As shown in FIG. 4, the top layer 216 is disposed along a first plane, the middle layer 218 is disposed along a second plane parallel to the first plane, and the bottom layer 220 is disposed along a third plane parallel to the second plane.

Each of the top boards 222 includes a first face 400, a second face 402 parallel to the first face 400, a first lateral side 404, and a second lateral side 406 parallel to the first lateral side 404. Similarly, each of the bottom boards 224 includes a first face 408, a second face 410 parallel to the first face 408, a first lateral side 412, and a second lateral side 414 parallel to the first lateral side 412. According to an exemplary embodiment, the middle layer 218 includes a single flexible member 416 having a first side 418 and a second side 420 parallel to the first side 418. In other embodiments, the middle layer 218 includes additional members having lateral sides as described with the top boards 222 and the bottom boards 224.

In an exemplary embodiment, the second side 402 of each of the top boards 222 is coupled to the first side 418 of the flexible member 416, and the first face 408 of each of the bottom boards 224 is coupled to the second side 420 of the flexible member 416. The first side 400 of the top boards 222 is contoured (e.g., shaped, etc.) relative to the second face 410 of the bottom boards 224.

In an exemplary embodiment, each of the top boards 222 is individually coupled to at least one adjacent top board 222, and each of the bottom boards 224 is individually coupled to at least one adjacent bottom board 224. In other embodiments, the top layer 216 is constructed (e.g., configured, structured, etc.) such that the first lateral side 404 of one of the top boards 222 interfaces with the second lateral side 406 of an adjacent one of the top boards 222. In some applications, the first lateral side 404 of one of the top boards 222 and the second lateral side 406 of an adjacent one of the top boards 222 each include a corresponding structural feature (e.g., protrusion, slot, etc.) configured to interact with one another to facilitate coupling of the adjacent top boards 222. For example, the first lateral side 404 may include a tongue, and the second lateral side 406 may include a corresponding groove structured (e.g., configured, etc.) to receive the tongue. Similarly, the bottom layer 220 is constructed (e.g., configured, structured, etc.) such that the first lateral side 412 of one of the bottom boards 224 interfaces with the second lateral side 414 of an adjacent one of the bottom boards 224. In some applications, the first lateral side 412 of one of the bottom boards 224 and the second lateral side 414 of an adjacent one of the bottom boards 224 each include a corresponding structural feature (e.g., protrusion, slot, etc.) configured to interact with one another to facilitate coupling of the adjacent bottom boards 224. For example, the first lateral side 412 may include a tongue, and the second lateral side 414 may include a corresponding groove structured (e.g., configured, etc.) to receive the tongue.

As shown in FIG. 4, the top layer 216 and the bottom layer 220 are configured (e.g., structured, etc.) such that interfaces between adjacent top boards 222 are offset (e.g., staggered, etc.) from interfaces between adjacent bottom boards 224 by a target distance. For example, interfaces between adjacent top boards 222 may be individually offset from an adjacent interface between adjacent bottom boards 224 by a target distance equal to half the length of one of an adjacent bottom board 224. By offsetting these interfaces, the structural integrity of the cover 204 is increased. In order to facilitate the offsetting of these interfaces, the cover 204 include different numbers and/or different sizes of the top boards 222 and the bottom boards 224.

The top layer 216 and the bottom layer 220 are configured such that a minimal number of the top boards 222 and a minimal number of the bottom boards 224 are utilized in the construction of the cover 204. The number of the top boards 222 and the number of the bottom boards 224 that are utilized in the construction of the cover 204 are based on the properties (e.g., modulus of elasticity, thickness, etc.) of the top boards 222 and the bottom boards 224, as well as the properties of the middle layer 218. For example, assuming that the top boards 222 and the bottom boards 224 are constructed from the same material, the cover 204 may be constructed from relatively fewer of the top boards 222 and the bottom boards 224 when the material has a lower modulus of elasticity, and relatively more of the top boards 222 and the bottom boards 224 when the material has a greater modulus of elasticity, assuming that the properties of the middle layer 218 are not varied. In this way, the material that the top boards 222 are constructed from is directly related to the number of the top boards 222 that are included in the top layer 216 and the material that the bottom boards 224 are constructed from is directly related to the number of the bottom boards 224 that are included in the bottom layer 220.

Figure 5:
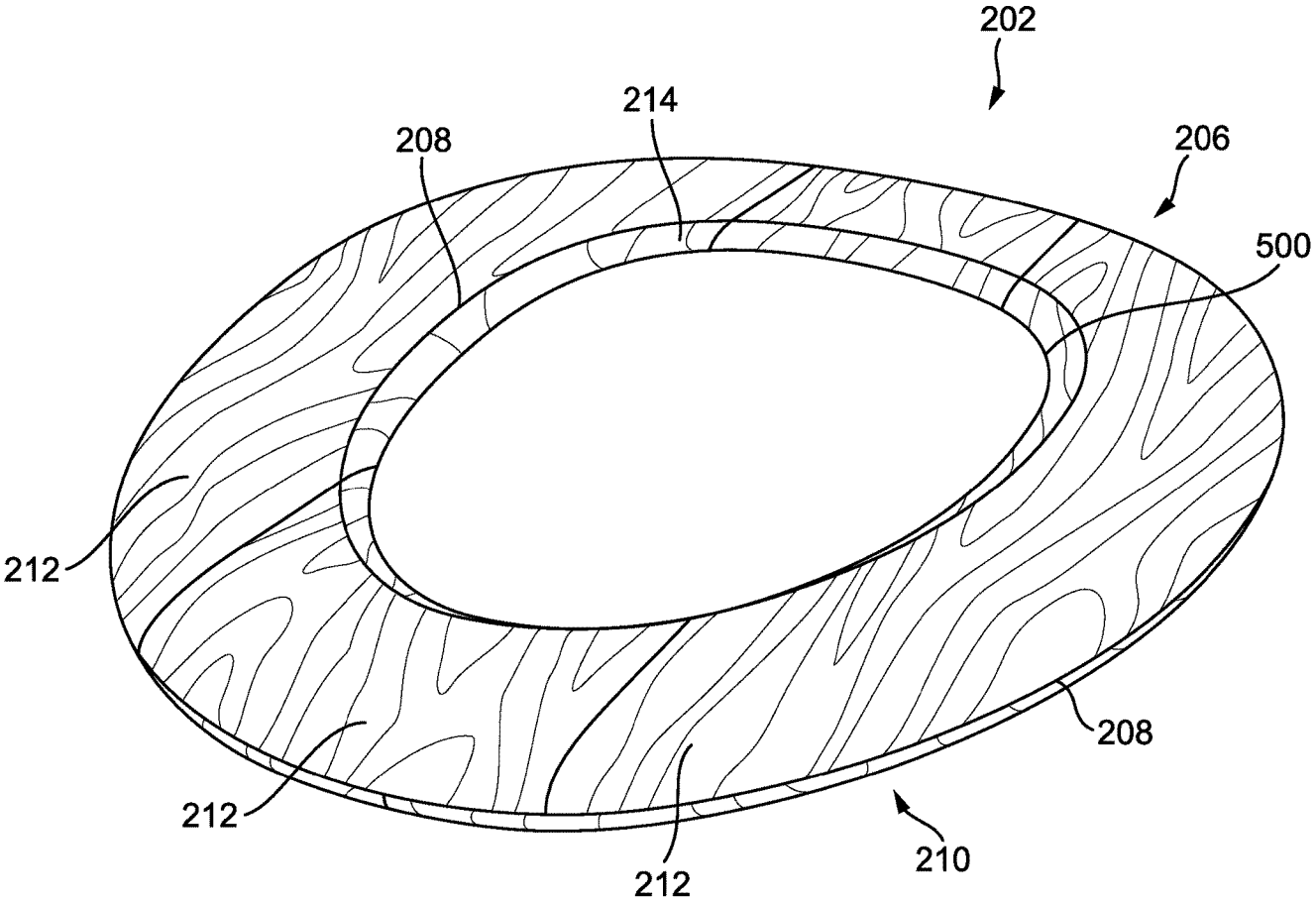
FIG. 5 is a perspective view of a seat for a toilet seat assembly, according to an exemplary embodiment of the present disclosure.
Figure 6:
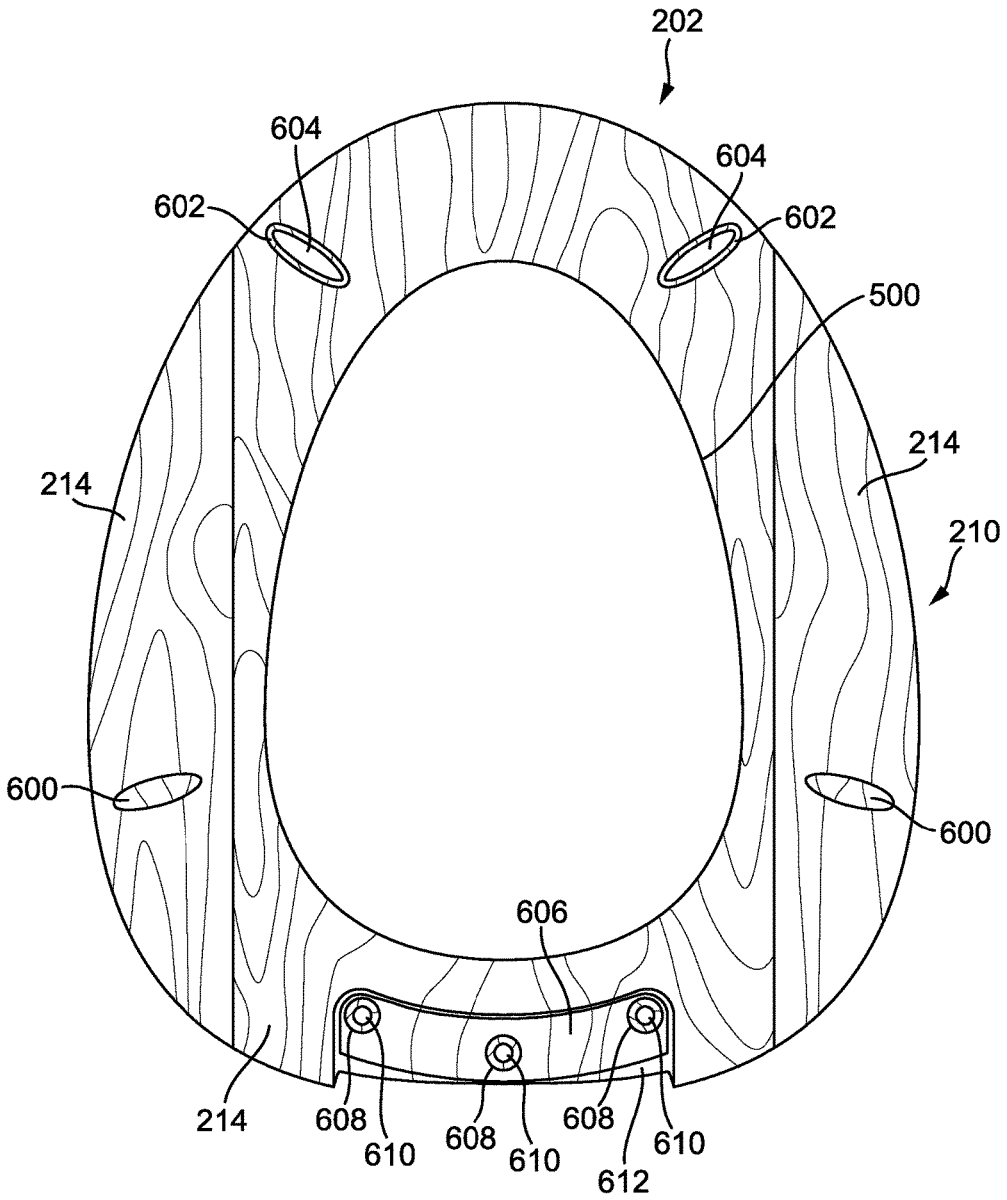
FIG. 6 is a bottom view of a seat for a toilet seat assembly, according to an exemplary embodiment of the present disclosure.

Referring to FIGS. 5 and 6, the seat 202 is shown in greater detail. The seat 202 defines an opening (e.g., aperture, hole, etc.), shown as an opening 500. According to an exemplary embodiment, the opening 500 is collectively defined by a plurality of the top boards 212 and a plurality of the bottom boards 214. Depending on the application, such as a configuration of the toilet 104, the opening 500 may be larger or smaller.

FIG. 5 also illustrates the contoured shape of the seat 202. The contoured shape may improve comfort and/or ease of cleaning of the seat 202. In this way, the seat 202 may obtain a shape similar to that of a molded plastic toilet seat while still providing the aesthetic benefits of wood. The top layer 206, the middle layer 208, and the bottom layer 210 may cooperate to establish the contour shape of the seat 202. In an exemplary embodiment, the top layer 206 is rounded along a contour, the middle layer 208 is rounded along the contour, and a portion of the bottom layer 210 is rounded along the contour (e.g., as opposed to the entire bottom layer 210 being rounded along the contour, etc.). For example, each of the top boards 212 may be sloped towards and away from the opening 500 such that the top layer 206 has a generally rounded shape and the first lateral side 312 and/or the second lateral side 314 of at least one of the bottom boards 214 may be similarly rounded.

FIG. 6 illustrates the bottom layer 210 such that the second face 310 of each of the bottom boards 214 is relatively flat and not contoured. As shown in FIG. 6, the seat 202 includes a first plurality of protrusions (e.g., protuberances, bumps, etc.), shown as rests 600, a plurality of rings (e.g., annular extrusions, annular protrusions, lips, etc.), shown as rings 602, and a second plurality of protrusions (e.g., protuberances, bumps, rests, etc.), shown as bumpers 604.

The rests 600 and the bumpers 604 are configured to selectively interface with the bowl 102 such that the rests 600 and the bumpers 604 collectively support the seat 202—and potentially the cover 204—on the bowl 102. The bumpers 604 may prevent side to side (e.g., lateral, etc.) motion of the seat 202 on the bowl 102. Similarly, the bumpers 604 may also reduce noise that occurs when the seat 202 contacts the bowl 102. The rests 600 and the rings 602 are in some embodiments integrated within the bottom boards 214 and extend from the second faces 310 thereof. Accordingly, the rests 600 and the rings 602 are constructed from the same wood as the bottom layer 220. As shown in FIG. 6, the rings 602 and the bumpers 604 are aligned along a front portion of the bottom boards 214, and the rests 600 are aligned along a rear portion of the bottom boards 214 that is opposite the front portion.

The rings 602 receive the bumpers 604 therein. For example, the bumpers 604 may be adhesively attached (e.g., adhered, etc.) to the second faces 310 within the rings 602. In an exemplary embodiment, the rests 600 extend from the second faces 310 a first distance, and the bumpers 604 extend from the second faces 310 a second distance approximately equal to the first distance. The bumpers 604 may be constructed from a polymeric, rubberized, or similar material. In some applications, the rests 600 are replaced with bumpers similar to the bumpers 604 surrounded by rings similar to the rings 602. In other applications, the bumpers 604 are replaced with rests similar to the rests 600, and the rings 602 are not included. While not shown, it is understood that the cover 204 may incorporate rests, rings, and bumpers similar to those described with respect to the seat 202.

The seat 202 also includes a recessed region 606. The recessed region 606 receives a portion of the hinge 205, and functions to couple the seat 202 to the hinge 205. While not shown, the cover 204 may include a similar recessed region. Within the recessed region 606, the seat 202 includes a plurality of rings (e.g., annular extrusions, annular protrusions, etc.), shown as rings 608, and a plurality of fittings (e.g., threaded fittings, etc.), shown as fittings 610, positioned within the rings 608. The fittings 610 receive coupling members (e.g., wooden dowels, fasteners, etc.) that couple the seat 202 to the hinge 205. For example, the fittings 610 may receive pressed-in wooden dowels. The fittings 610 may be threaded into the seat 202 within the rings 608 or may be otherwise adhered to the seat 202 within the rings 608.

In some embodiments, the seat 202 includes a recessed border 612 that borders the recessed region 606 and extends into the seat 202 beyond the recessed region 606. When the hinge 205 is coupled to the seat 202, a lip on the hinge 205 may extend into the recessed border around the recessed region 606. In this way, the lip on the hinge 205 and the recessed border 612 cooperate to locate the seat 202 with respect to the hinge 105.

According to various embodiments, each of the seat 202, the cover 204, and the opening 500 is symmetrical about one axis. For example, the rests 600 may be located on opposite sides of a line of symmetry of the seat 202. The toilet seat assembly 100 may be variously configured for different configurations of the toilet 104. For example, if the bowl 102 is elongated, the toilet seat assembly 100 is similarly elongated.

Figure 7:
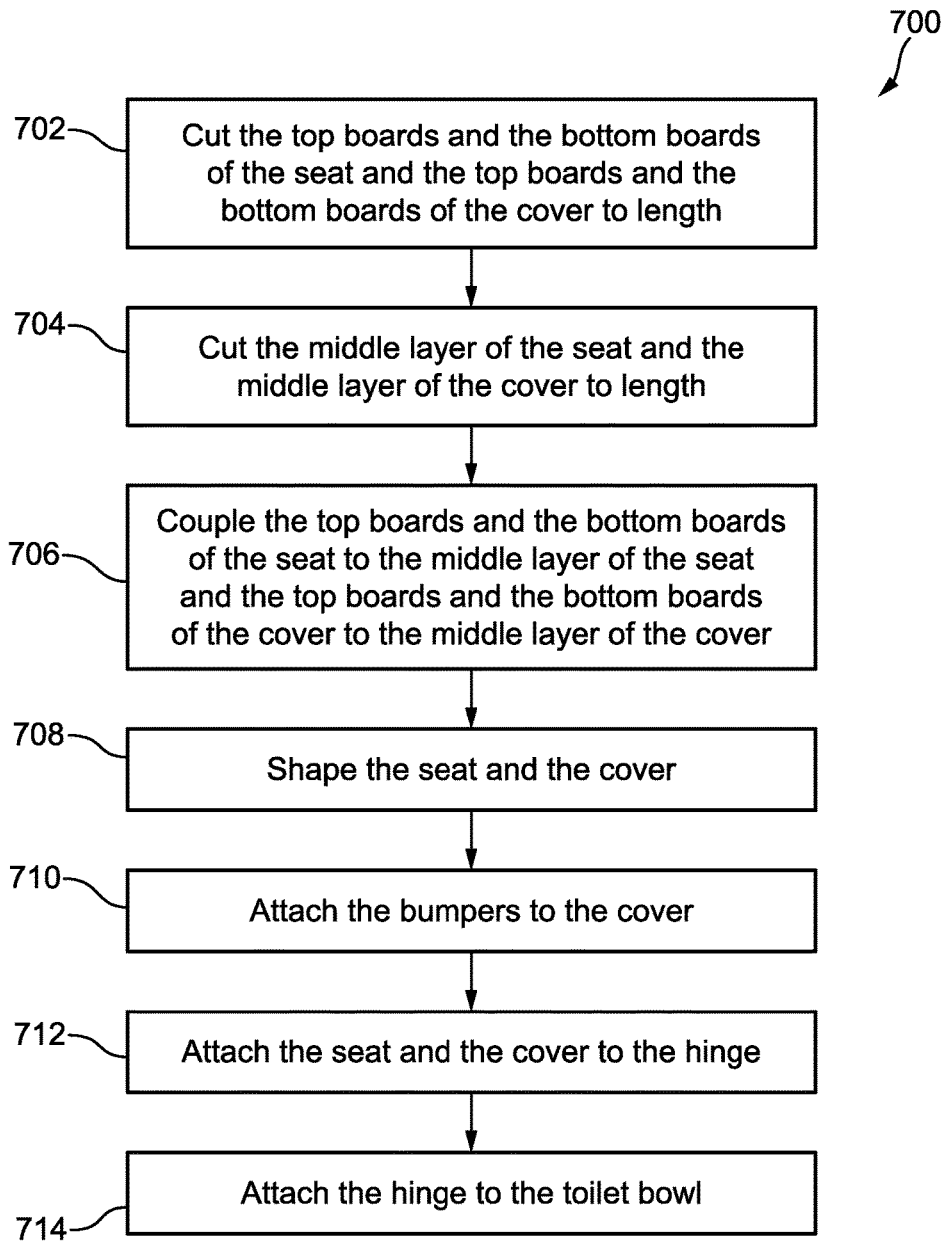
FIG. 7 is a flow diagram illustrating a process for constructing a toilet seat assembly, according to an exemplary embodiment of the present disclosure.

FIG. 7 illustrates a process (e.g., progression, etc.), shown as a process 700, for constructing the toilet seat assembly 100. The process 700 includes, in step 702, cutting the top boards 212 and the bottom boards 214 of the seat 202 as well as the top boards 222 and the bottom boards 224 of the cover 204 to length. For example, if the seat 202 includes four of the top boards 212, the top boards 212 may be cut to lengths of, for example, fourteen inches and twenty-two inches. The process 700 further includes, in step 704, cutting the middle layer 208 of the seat 202 as well as the middle layer 218 of the cover 204 to length. For example, the middle layer 218 may be cut into an oval or egg shape slightly larger than a finished perimeter of the cover 204. Similarly, the middle layer 208 may be precut with an opening having a perimeter slightly smaller than a perimeter of the opening 500. During steps 702 and 704, the seat 202 and the cover 204 are roughly formed.

Next, in step 706, the process 700 includes coupling the top boards 212 and the bottom boards 214 of the seat 202 to the middle layer 208 and coupling the top boards 222 and the bottom boards 224 of the cover 204 to the middle layer 218. For example, the top boards 212 and the bottom boards 214 of the seat 202 may be adhesively attached to the middle layer 208. Step 706 may include applying a compressive force to facilitate coupling. For example, the top boards 222 and the bottom boards 224 of the cover 204 may be drawn together (e.g., via a clamp, via a press, etc.). Next, in step 708, the process 700 includes shaping (e.g., rounding, etc.) the seat 202 and the cover 204. In step 708, the top boards 212 and the middle layer 208 of the seat are given a rounded contour and the bottom boards 224 may be partially rounded to follow the contour. During step 708, the opening 500 is formed. If desired, the seat 202 and/or the cover 204 are stained, painted, coated, or treated after step 708.

Next, in step 710, the process 700 includes attaching the bumpers 604 to the seat 202. Next, in step 712, the process 700 includes coupling the hinge 205 to both the seat 202 and the cover 204. Finally, in step 714, the process 700 concludes with coupling the hinge 205 to the bowl 102. While the process 700 has been described with the steps being performed in a specific order, it is to be understood that the steps may be rearranged in a number of ways. Similarly, it is to be understood that more or less steps could be included within the process 700 and that such changes are within the scope of the process 700 as described herein.

Figure 8:
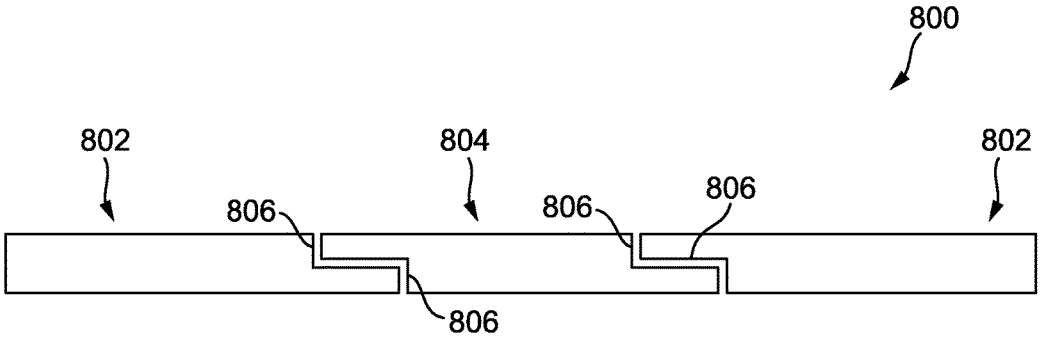
FIG. 8 is a cross-sectional view of a layer for use in the construction of a toilet seat assembly, according to an exemplary embodiment of the present disclosure.

FIG. 8 illustrates a layer, shown as a layer 800, according to one embodiment. The layer 800 represents an alternative construction of any of the top layer 206, the bottom layer 210, the top layer 216, and the bottom layer 220 that may be utilized in some applications. The layer 800 utilizes lap joints, as opposed to layered butt joints as described in FIG. 3 and FIG. 4. The layer 800 is shown to include a first member, shown as an end board 802, a second member, shown as a middle board 804, and another end board 802. Each of the end boards 802 includes a member, shown as a coupling member 806, and each of the middle boards 804 includes two coupling members 806. The layer 800 is assembled by positioning the coupling member 806 on an end board 802 within the coupling member 806 on a middle board 804. In some instances, the layer 800 may include multiple middle boards 804 arranged in series. The coupling members 806 cooperate to form lap joints that provide an increased coupling surface where, for example, adhesive may be applied.

In an alternative embodiment, the seat 202 and/or the cover 204 are constructed such that the middle layer 208 and/or the middle layer 218 is hidden. For example, an outermost one of the top boards 212 and an outermost one of the bottom boards 214 may be coupled together along an outer edge and configured such that an internal cavity is partially defined therebetween. The middle layer 208 extends into this cavity but is hidden by the coupling along the outer edge. A similar configuration may be applied along an inner edge of the seat (e.g., around the opening 500, etc.).

As utilized herein, the terms "approximately," "about," "parallel," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. It is understood that the term "parallel" is intended to encompass de minimis variations as would be understood to be within the scope of the disclosure by those of ordinary skill in the art.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments and that such variations are intended to be encompassed by the present disclosure.

The construction and arrangement of the elements of the seat 202, the cover 204, and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Other substitutions, modifications, changes, and omissions may also be made in the design, operating conditions, and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

What is claimed is:

1. A toilet seat comprising:

a first layer comprising a first wood board, the first layer having a first surface and a second surface;

a second layer comprising a flexible material, the second layer coupled to the second surface of the first layer; and a third layer comprising a second wood board, the third layer coupled to the second layer opposite the first layer.

2. The toilet seat of claim 1, wherein the first surface is contoured relative to the first surface.

3. The toilet seat of claim 1, wherein the first layer comprises a plurality of first wood boards;

wherein the third layer comprises a plurality of second wood boards; and wherein the at least one first wood board of the first layer is offset a target distance relative to the at least one second wood board of the third layer.

4. The toilet seat of claim 1, further comprising a pair of bumpers;

wherein the third layer comprises a pair of rings extending from the third layer and a pair of rests, the pair of rings aligned on a front portion of the third layer and the pair of rings configured to individually receive one of the pair of bumpers; and wherein the pair of rests are aligned on a rear portion of the third layer opposite the front portion.

5. The toilet seat of claim 4, wherein the pair of bumpers are constructed from rubberized material and are adhesively attached to the third layer within each of the pair of rings; and wherein the pair of rests extend from the third layer and are structurally integrated therein.

6. The toilet seat of claim 1, wherein the third layer comprises a recessed region opposite the second layer, the recessed region including at least one fitting configured to receive a fastener; and wherein the recessed region is surrounded by a recessed outline.

7. The toilet seat of claim 6, wherein the recessed region is configured to receive a hinge; and wherein the recessed outline is configured to receive a lip of the hinge.

8. A toilet seat assembly comprising:

a seat; and a cover coupled to the seat, the cover rotatable with respect to the seat;

wherein one of the seat and the cover comprises:

a first layer comprising a first board and a second board;

a second layer comprising a first flexible material having a first side and a second side opposite the first side, the first side coupled to the first board and the second board; and a third layer comprising a third board and a fourth board, the third board and the fourth board coupled to the second side.

9. The toilet seat assembly of claim 8, wherein the other of the seat and the cover comprises:

a fourth layer comprising a fifth board and a sixth board;

a fifth layer comprising a second flexible material having a third side and a fourth side opposite the third side, the third side coupled to the fifth board and the sixth board; and a sixth layer comprising a seventh board and an eighth board, the seventh board and the eighth board coupled to the fourth side.

10. The toilet seat assembly of claim 9, wherein the first flexible material is the same as the second flexible material.

11. The toilet seat assembly of claim 8, wherein the first layer comprises a fifth board;

wherein the first board is positioned adjacent to the second board, thereby defining a first interface;

wherein the second board is positioned adjacent to the fifth board, thereby defining a second interface;

wherein the third board is positioned adjacent to the fourth board, thereby defining a third interface; and wherein the third interface is offset from the first interface and the second interface.

12. The toilet seat assembly of claim 8, wherein the first board and the second board are coupled to each other; and wherein the third board and the fourth board are coupled to each other.

13. The toilet seat assembly of claim 8, wherein the first flexible material has a modulus of elasticity less than a modulus of elasticity of any of the first board, the second board, the third board, and the fourth board.

14. The toilet seat assembly of claim 8, wherein the first layer is disposed along a first plane, the second layer is disposed along a second plane, and the third layer is disposed along a third plane;

wherein the first plane is parallel to the second plane; and wherein the second plane is parallel to the third plane.

15. A toilet seat comprising:

a first layer comprising a first board, a second board, a third board, and a fourth board;

a second layer comprising a flexible material having a first side and a second side opposite the first side, the first side coupled to the first board, the second board, the third board, and the fourth board; and a third layer comprising a fifth board, a sixth board, and a seventh board, the fifth board, the sixth board, and the seventh board coupled to the second side;

wherein the first board, the second board, the third board, and the fourth board are aligned along a first plane; and wherein the fifth board, the sixth board, and the seventh board are aligned along a second plane parallel to the first plane.

16. The toilet seat of claim 15, wherein the flexible material separates the first layer from the second layer.

17. The toilet seat of claim 15, wherein the first layer defines a first surface not coupled to the first side;

wherein the third layer defines a second surface not coupled to the second side;

wherein a flat portion of the second surface is aligned with a third plane parallel to the second plane; and wherein the first surface and a remaining portion of the second surface are contoured relative to the flat portion.

18. The toilet seat of claim 15, wherein the first board, the second board, the third board, the fourth board, the fifth board, the sixth board, and the seventh board individually display a separate visible wood grain.

19. The toilet seat of claim 15, wherein the first layer, the second layer, and the third layer collectively define an opening therethrough.

20. The toilet seat of claim 15, wherein the flexible material has a modulus of elasticity less than a modulus of elasticity of any of the first board, the second board, the third board, the fourth board, the fifth board, the sixth board, and the seventh board.

* * * * *